US010716986B2

(12) United States Patent
Winter et al.

(10) Patent No.: US 10,716,986 B2
(45) Date of Patent: Jul. 21, 2020

(54) SPORTS TRAINING VISOR

(71) Applicant: 7450 Richmond LLC, Milton, GA (US)

(72) Inventors: Clint R. Winter, Milton, GA (US); Cavan Cohoes, Milton, GA (US)

(73) Assignee: 7450 RICHMOND LLC, Milton, GA (US)

( * ) Notice: Subject to any disclaimer, the term of this patent is extended or adjusted under 35 U.S.C. 154(b) by 0 days.

(21) Appl. No.: 16/170,286

(22) Filed: Oct. 25, 2018

(65) Prior Publication Data

US 2019/0118057 A1 Apr. 25, 2019

Related U.S. Application Data

(60) Provisional application No. 62/576,749, filed on Oct. 25, 2017.

(51) Int. Cl.

| | |
|---|---|
| ***A63B 69/00*** | (2006.01) |
| ***A42B 3/04*** | (2006.01) |
| *A42B 3/22* | (2006.01) |

(52) U.S. Cl.

CPC ..... *A63B 69/002* (2013.01); *A42B 3/0406* (2013.01); *A63B 69/00* (2013.01); *A63B 69/0002* (2013.01); *A63B 69/0024* (2013.01); *A63B 69/0026* (2013.01); *A42B 3/227* (2013.01); *A63B 2243/007* (2013.01)

(58) Field of Classification Search

CPC . A63B 69/0002; A63B 69/00; A63B 69/0024; A63B 69/0026; A63B 2243/007; A63B 69/36; A63B 69/3608; A42B 2/0406; B42D 15/008; A61F 9/045; A41D 20/00

USPC ..... 473/422, 458, 450, 464, 210, 211, 268, 473/252; 2/424, 10, 909, 12

See application file for complete search history.

(56) References Cited

U.S. PATENT DOCUMENTS 2,679,047 A * 5/1954 Bozzi ..... B42D 15/008 2/12
3,228,696 A * 1/1966 Hull ..... A63B 69/3608 473/210

(Continued)

FOREIGN PATENT DOCUMENTS

DE 29815333 U1 3/1999
JP 2006/002334 A 1/2006

OTHER PUBLICATIONS

International Journal of Sports Physical Therapy (IJSPT), The Effect of Tackling Training on Head Accelerations in Youth—Published Apr. 2018.*

(Continued)

*Primary Examiner* — Mitra Aryanpour
(74) *Attorney, Agent, or Firm* — BakerHostetler

(57) ABSTRACT

A method for training an athlete to adopt a vertical head-up position includes: placing a visor comprising an opaque region over the face of the athlete such that the opaque region of the visor blocks the upper peripheral vision of the athlete if the athlete lowers his/her head below the vertical head-up position; and having the athlete train with the visor over his/her face to teach the athlete to keep the head in the vertical head-up position, thereby minimizing a risk of head-to-head contact with another athlete during a game. An apparatus for training an athlete to adopt a vertical head-up position is also described.

10 Claims, 4 Drawing Sheets

(56) References Cited

U.S. PATENT DOCUMENTS 3,594,007 A * 7/1971 Kalberer ..... A63B 69/3608 473/211
3,613,116 A * 10/1971 Stroup ..... A61F 9/045 473/450
3,660,852 A * 5/1972 Schulenberg ..... A61F 9/045 2/12
4,063,740 A * 12/1977 Mader ..... A63B 69/3608 473/210
4,247,957 A * 2/1981 Rogers ..... A61F 9/045 2/12
4,303,241 A * 12/1981 Burroughs ..... A63B 69/00 473/458
4,531,743 A * 7/1985 Lott ..... A63B 69/3608 473/210
4,739,991 A * 4/1988 Flinn, Jr. ..... A63B 69/3608 473/210
4,781,451 A * 11/1988 McAllen ..... G02C 3/02 351/155
4,811,430 A * 3/1989 Janusz ..... A41D 20/00 2/171
4,852,882 A * 8/1989 Otsuka ..... A63B 69/3608 473/210
4,856,535 A * 8/1989 Forbes ..... A41D 13/1176 128/857
4,896,375 A * 1/1990 Colucci ..... A63B 69/3608 473/210
5,135,446 A * 8/1992 Cooley ..... A63B 69/0022 2/463
5,413,346 A * 5/1995 Hedlund ..... A63B 69/3608 473/210
5,488,438 A * 1/1996 Cochran ..... A61F 9/02 473/59
5,521,653 A * 5/1996 Anderson ..... A61F 9/02 351/156
5,647,066 A * 7/1997 Joslin ..... A42B 3/221 2/10
6,390,823 B1 * 5/2002 Wesenhagen ..... A63B 69/3608 434/252
7,997,992 B2 * 8/2011 Rim ..... A42B 1/24 473/210
8,512,172 B1 * 8/2013 Glynn ..... A63B 69/0002 473/458
8,747,260 B1 * 6/2014 Glynn ..... A63B 71/0622 473/458
2004/0259656 A1 * 12/2004 Miracle ..... A63B 69/3608 473/268
2006/0240915 A1 * 10/2006 Hohl, Jr. ..... A63B 69/0071 473/447
2012/0157243 A1 * 6/2012 Gallo ..... A63B 69/0002 473/438
2012/0180204 A1 7/2012 Hawkins
2014/0038750 A1 * 2/2014 Leech ..... A63B 69/3608 473/407
2014/0121792 A1 * 5/2014 Jennings ..... A63B 67/002 473/499
2014/0259254 A1 9/2014 King
2015/0051024 A1 * 2/2015 Churchman ..... A63B 71/0622 473/438
2015/0150726 A1 6/2015 Flaxman
2015/0273304 A1 * 10/2015 Glynn ..... A63B 69/0002 473/458
2015/0343294 A1 * 12/2015 Leech ..... A63B 71/0619 473/209
2015/0366284 A1 12/2015 Dowling et al.

OTHER PUBLICATIONS

Journal of Athletic Training, National athletic Trainers' Association Position Statement: Head-Down Contact and Spearing in Tackle Football—Published Jan. Mar. 2004.*

* cited by examiner

SPORTS TRAINING VISOR

RELATED APPLICATION

The present application claims priority to and the benefit of U.S. Provisional Application No. 62/576,749 filed Oct. 25, 2017, the disclosure of which is incorporated herein by this reference in its entirety.

FIELD OF THE DISCLOSURE

The present disclosure relates to a sports training aid, and in particular to a sports training aid that teaches an athlete to keep his/her head in a proper vertical head-up position, thereby minimizing the risk of the athlete's head being positioned improperly while encountering head-to-head contact with another athlete during a game.

BACKGROUND OF THE DISCLOSURE

Head and neck injuries due to head-down contact in sports in which such contact may occur (such as football, lacrosse, hockey and baseball) are an increasing concern. Of particular concern is the health risk to an athlete that suffers a concussion. Health risks—including short-term and long-term risks—are accelerated when an athlete suffers multiple concussions.

One study at the National Center for Catastrophic Sport Injury Research (NCCSIR) at the University of North Carolina at Chapel Hill, for example, identified six football-related fatalities that occurred during the 2014 season; five occurred at the high school level and one at the college level. See https://nccsir.unc.edu/files/2013/10/Annual-Football-2014-Fatalities-Final.pdf. All but one of the fatalities occurred during regularly scheduled games, the other occurred during practice. The football activities attributed to the direct fatalities were tackling, helmet to helmet collision, warm-up drills, and unknown activities. Five of the fatalities involved brain injury; the other involved a cervical fracture.

A major contributing factor to head and neck injuries in contact sports is head-down contact, defined as a player initiating contact with the crown (top) of the helmet. Head-down contact may be intentional or unintentional. Intentional initiation of head-down contact is referred to as "spearing." Head-down contact can result in head injuries and axial loading of the spine, which can lead to, e.g., cervical fractures.

At least in part due to increased recognition of the risk of head injuries due to head-down contact, there has been an increased focus in all levels of play (e.g., professional, collegiate, high school, youth) on teaching the player to keep their head up and initiate contact with the shoulder or chest. Such forms of contact can be effective if performed correctly, and are much safer. Head-up contact must be learned, however, due to the natural tendency of a player/athlete to adjust their positioning or shy away just before contact, which can result in the player dropping their head. While head-up contact drills can be practiced, conventional methods for training a player to keep his/her head up do not provide instantaneous feedback to let the player know if they are dropping their head just before contact.

These and other shortcomings are addressed by aspects of the present disclosure.

SUMMARY

Aspects of the disclosure relate to a method for training an athlete to adopt a vertical head-up position includes: placing a visor including an opaque region over the face of the athlete such that the opaque region of the visor blocks the upper peripheral vision of the athlete if the athlete lowers his/her head below the vertical head-up position; and having the athlete train with the visor over his/her face to teach the athlete to keep the head in the vertical head-up position, thereby minimizing a risk of head-to-head contact with another athlete during a game.

Aspects of the disclosure further relate to an apparatus for training an athlete to adopt a vertical head-up position, including a visor configured to be worn over a face of an athlete at an eye level of the athlete, the visor including: an opaque region that blocks an upper peripheral vision of the athlete if the athlete lowers his/her head below the vertical head-up position; and a plurality of score lines. The plurality of score lines allow a portion of the visor to be removed so as to allow sizing of the visor for athletes of different size. The visor teaches the athlete to keep his/her head in the vertical head-up position, thereby minimizing a risk of head-to-head contact with another athlete during a game.

Further aspects of the disclosure relate to an apparatus for training an athlete to adopt a vertical head-up position, including: a first visor configured to be worn over a face of an athlete at an eye level of the athlete, the first visor including an opaque region that blocks an upper peripheral vision of the athlete if the athlete lowers his/her head below the vertical head-up position; and a second visor including a light transmissive region and a slot for receiving the first visor. The first visor teaches the athlete to keep his/her head in the vertical head-up position, thereby minimizing a risk of head-to-head contact with another athlete during a game.

BRIEF DESCRIPTION OF THE FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various aspects discussed in the present document.

DETAILED DESCRIPTION

Figure 1A:
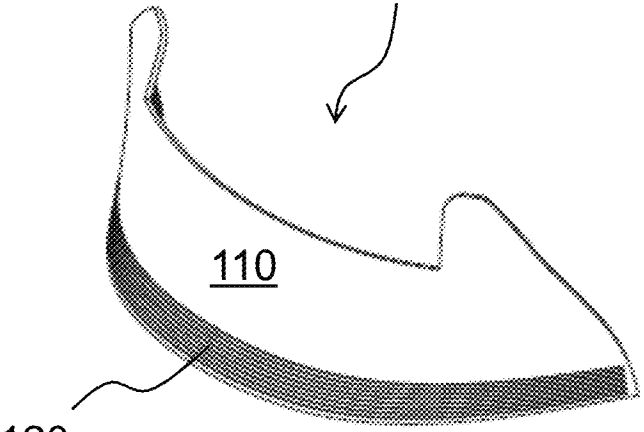
FIG. 1A is a top perspective view of a sports training visor according to an aspect of the disclosure.
Figure 1B:
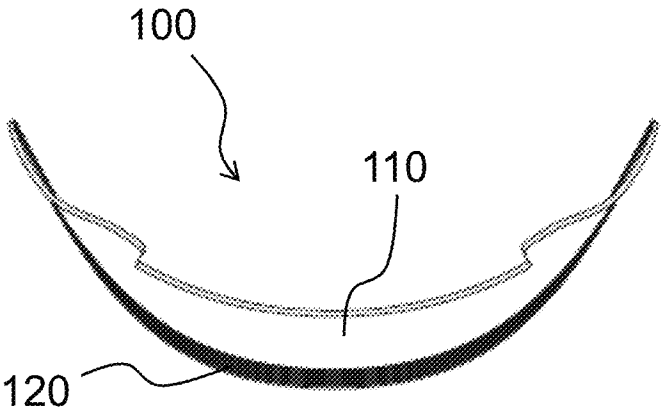
FIG. 1B is a top view of the sports training visor of FIG. 1A.
Figure 1C:
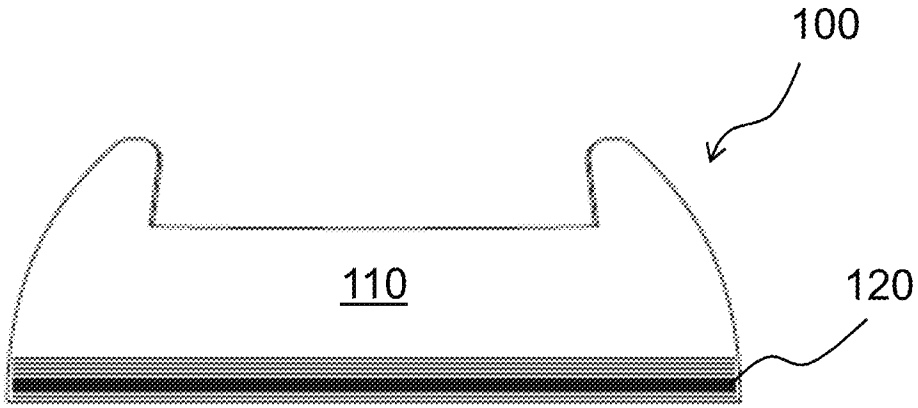
FIG. 1C is a front view of the sports training visor of FIG. 1A.
Figure 1D:
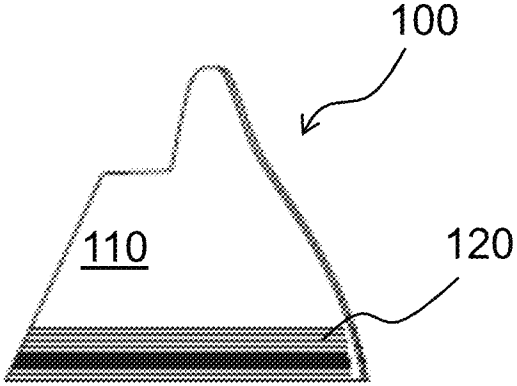
FIG. 1D is a side view of the sports training visor of FIG. 1A.

The present disclosure can be understood more readily by reference to the following detailed description of the disclosure and the Examples included therein. In various aspects, the present disclosure pertains to methods for training an athlete to adopt a vertical head-up position, including:

placing a visor including an opaque region over the face of the athlete such that the opaque region of the visor blocks an upper peripheral vision of the athlete if the athlete lowers the head below the vertical head-up position; and having the athlete train with the visor over the face to teach the athlete to keep the head in the vertical head-up position, thereby minimizing a risk of head-to-head contact with another athlete during a game.

Before the present apparatus, articles, systems, devices, and/or methods are disclosed and described, it is to be understood that they are not limited to specific synthetic methods unless otherwise specified, or to particular reagents unless otherwise specified, as such can, of course, vary. It is also to be understood that the terminology used herein is for the purpose of describing particular aspects only and is not intended to be limiting.

Various combinations of elements of this disclosure are encompassed by this disclosure, e.g., combinations of elements from dependent claims that depend upon the same independent claim.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

All publications mentioned herein are incorporated herein by reference to disclose and describe the methods and/or materials in connection with which the publications are cited.

Definitions

It is also to be understood that the terminology used herein is for the purpose of describing particular aspects only and is not intended to be limiting. As used in the specification and in the claims, the term "comprising" can include the embodiments "consisting of" and "consisting essentially of" Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to a visor including "a score line" includes a visor having two or more score lines.

As used herein, the term "combination" is inclusive of blends, mixtures, alloys, reaction products, and the like.

As used herein, the terms "about" and "at or about" mean that the amount or value in question can be the designated value, approximately the designated value, or about the same as the designated value. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

Unless otherwise stated to the contrary herein, all test standards are the most recent standard in effect at the time of filing this application.

Each of the materials disclosed herein are either commercially available and/or the methods for the production thereof are known to those of skill in the art.

It is understood that the apparatus disclosed herein has certain functions. Disclosed herein are certain structural requirements for performing the disclosed functions and it is understood that there are a variety of structures that can perform the same function that are related to the disclosed structures, and that these structures will typically achieve the same result.

Apparatus for Training Athlete to Adopt a Vertical Head-up Position

With reference to FIGS. 1A-1D, aspects of the disclosure relate to an apparatus for training an athlete to adopt a vertical head position. The apparatus is a visor 100 configured to be worn over a face of an athlete at an eye level of the athlete, and includes an opaque region 110 and a plurality of score lines 120.

The bottom of the opaque region 110 of the visor 100 may be configured to fall at or around the eye level of the athlete when the visor 100 is placed over the face of the athlete. In this manner, the opaque region 110 blocks the upper peripheral vision of the athlete if the athlete lowers his/her head below their vertical head-up position. As used herein "vertical head-up position" is a head position that is vertical (i.e., perpendicular to the ground) to a position that is up to about 20 degrees from vertical. As the athlete lowers his/her head below their vertical head-up position, the opaque region 110 of the visor 100 blocks the upper peripheral vision of the athlete, providing feedback to the athlete that their head is out of proper position for head-up contact with another athlete. The visor 100 thus teaches the athlete to keep his/her head in a vertical head-up position, thereby minimizing the risk of head-to-head contact with another athlete during a game. In some aspects the visor 100 may also promote a horizontal head position by the athlete, in that the lateral peripheral vision of the athlete will be blocked if the athlete's head is positioned too far to the left or the right.

The plurality of score lines 120 allow a portion of the visor 100 to be removed so as to allow sizing of the visor 100 for athletes of different size. The plurality of score lines 120 may include grooves, channels, indentations, or other marks on the visor 100 that allow a portion of the visor 100 to be removed at one or more of the score lines 120. In this manner, the visor 100 can be easily re-sized for smaller athletes (e.g., youth athletes) without the need to manufacture different sizes of visors.

The visor 100 may include any suitable material. Exemplary materials include, but are not limited to, plastic (e.g., polycarbonate), fabric, rubber, mesh or a combination thereof.

Figure 2B:
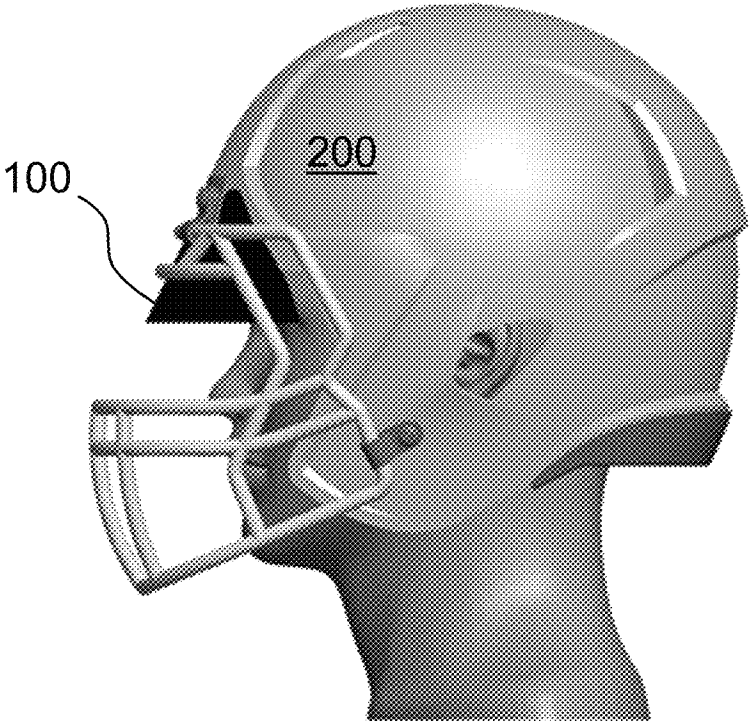
FIG. 2B is a side view of the sports training visor and football helmet of FIG. 2A.
Figure 2A:
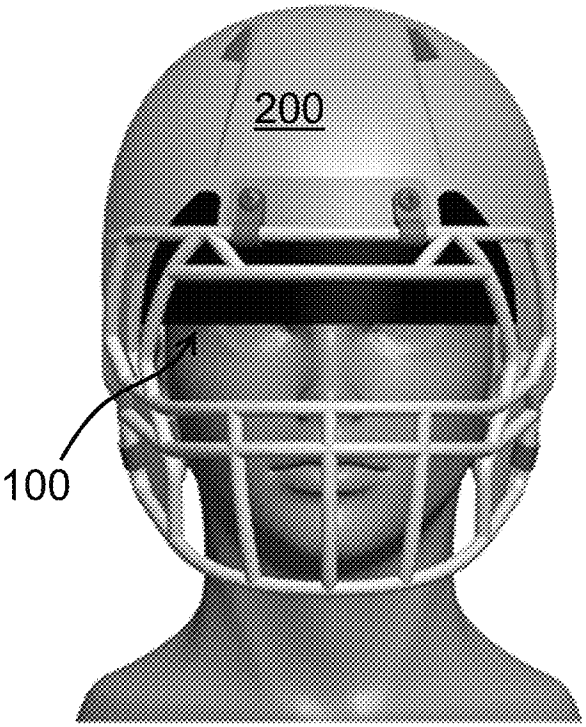
FIG. 2A is a front view of a sports training visor attached to a football helmet according to an aspect of the disclosure.

With further reference to FIGS. 2A and 2B, in some aspects the visor 100 is attached to a helmet or headgear 200. While the visor 100 is shown attached to a football helmet and inside a facemask thereof, it could be attached to the outside of the facemask in some aspects. The visor 100 may be attached to the helmet or headgear 200 with any suitable fastening means. In some aspects the visor 100 is attached to the helmet or headgear 200 with one or more of a snap, a strap, a hook and loop fastener, tape, a screw or a pin. Thus, in some aspects the visor 100 may be attached to the helmet or headgear 200 without the use of tools. The visor 100 may be attached to the helmet or headgear 200 at any suitable connection point, including but not limited to the top of the visor 100, one or both of the sides of the visor 100, and/or the bottom of the visor 100. The visor 100 may be contoured to fit the shape of the helmet or headgear 200 and/or the shape of the face of the athlete.

Figure 3B:
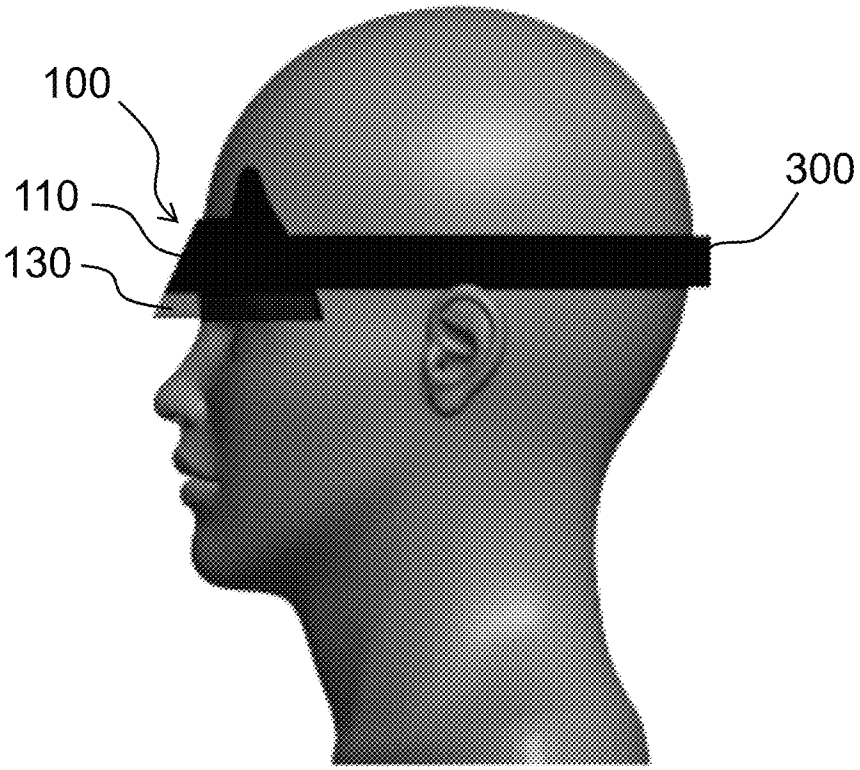
FIG. 3B is a side view of the sports training visor of FIG. 3A.
Figure 3A:
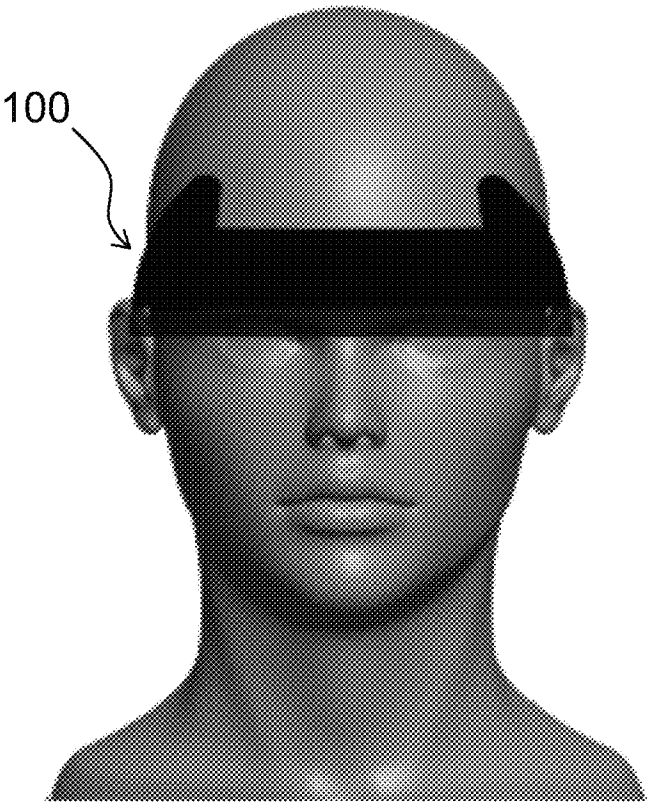
FIG. 3A is a front view of a sports training visor according to an aspect of the disclosure.

As shown in FIGS. 3A and 3B, in some aspects a mounting apparatus 300 may be attached directly to the visor 100, so that the visor 100 may be attached directly to the head and over the face of the athlete (i.e., rather than to a helmet or headgear worn by the athlete). In some aspects the mounting apparatus 300 is a headband. The visor 100 may be contoured to shape the face of the athlete.

As noted above, the visor 100 includes an opaque region 110 that blocks the upper peripheral vision of the athlete if the athlete lowers his/her head below their vertical head-up position. In some aspects the entire visor 100 is opaque. In other aspects, illustrated in FIGS. 3A and 3B, the visor 100 includes a light transmissive region 130 located proximate the opaque region 110 and configured to be below the opaque region 110 when the visor 100 is worn by the athlete so that the athlete can see through the light transmissive region 130 of the visor 100 when the athlete's head is in the vertical head-up position.

The light transmissive region 130 may further include in some aspects (not illustrated) a plurality of indicator lines. The indicator lines are visible to the athlete when the visor 100 is over the face and provide an indication to the athlete of a degree to which the head position is deviating from the vertical head-up position (e.g., partial deviation, moderate deviation or substantial deviation).

In yet further aspects (not illustrated) the light transmissive region may include a first region proximate the opaque region with a first degree of tint and a second region with a second degree of tint. The first degree of tint is darker than the second degree of tint such that when the visor is over the face the first degree of tint and the second degree of tint provide an indication to the athlete of a degree to which the head position is deviating from the vertical head-up position. In such aspects, an athlete may see a light tint and perceive that his/her head position is in a good vertical position. If the athlete begins to deviate from that vertical position he/she may see a darker tint, indicating that they should adjust their head position. If the head position continues to degrade then the upper peripheral vision of the athlete will be blocked by the opaque region 110 of the visor 100 as described above.

In certain aspects (not illustrated) the light transmissive region may include a first region proximate the opaque region with at least a first color and a second region with a second color. The first color (e.g. translucent yellow) and the second color (e.g., translucent green) provide an indication to the athlete of a degree to which the head position is deviating from the vertical head-up position. In such aspects, an athlete may see the second color (e.g., translucent green, which could represent a good "go" position) and perceive that his/her head position is in a good vertical position. If the athlete begins to deviate from that vertical position he/she may see a the first color (e.g., translucent yellow, which could represent "caution"), indicating that they should adjust their head position. If the head position continues to degrade then the upper peripheral vision of the athlete will be blocked by the opaque region 110 of the visor 100 as described above. The light transmissive region of the visor could have more than two colors, i.e., in some aspects it could include a third color (e.g., translucent red) located closer to the opaque region 110 of the visor 100 that could serve as a warning that the athlete is about to lose his/her upper peripheral vision and to adjust it accordingly.

With reference to FIGS. 4A-4D, in some aspects an apparatus 400 for training an athlete to adopt a vertical head-up position includes:

a first visor 410 configured to be worn over a face of an athlete at an eye level of the athlete, the first visor 410 including an opaque region that blocks an upper peripheral vision of the athlete if the athlete lowers the head below the vertical head-up position; and a second visor 420 including a light transmissive region and a slot 430 for receiving the first visor 410.

The first visor teaches the athlete to keep his/her head in the vertical head-up position, thereby minimizing a risk of head-to-head contact with another athlete during a game. The first visor 410 may be fully or partially inserted into the slot 430 in the second visor 420. In other words, the slot 430 may be large enough to receive all (or substantially all) of the first visor 410. In some aspects the first visor includes a tab 415 to facilitate insertion and removal of the first visor 410 into the slot 430 of the second visor 420.

Figure 4A:
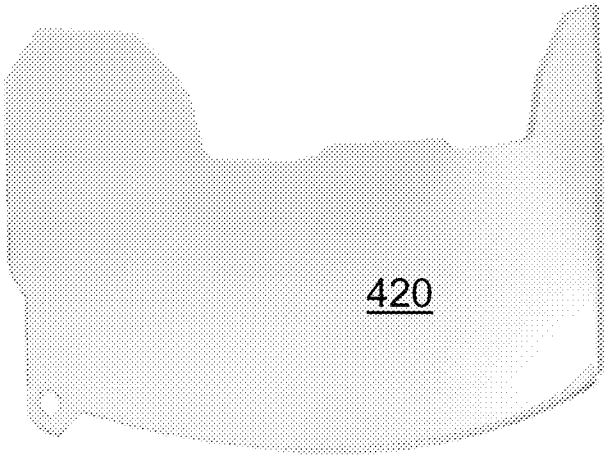
FIG. 4A is a front view of a second visor including a slot according to an aspect of the disclosure.
Figure 4B:
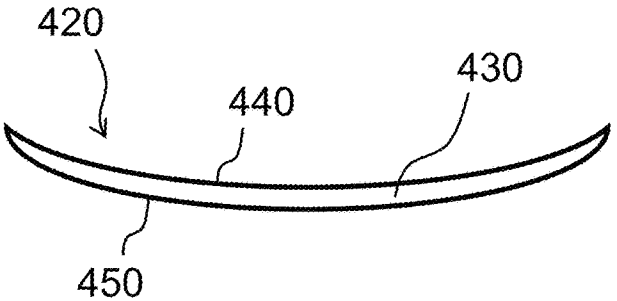
FIG. 4B is a top view of the second visor of FIG. 4A showing the slot for receiving a first visor.
Figure 4C:
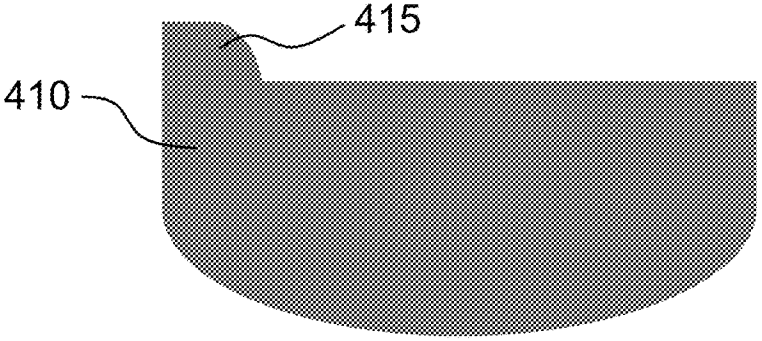
FIG. 4C is a front view of a first visor according to the aspect of FIGS. 4A and 4B.
Figure 4D:
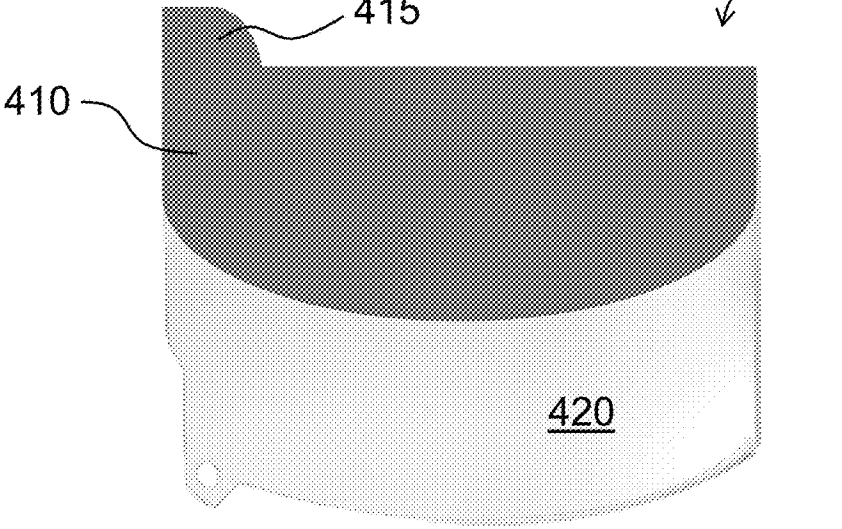
FIG. 4D is a front view of an apparatus incorporating the first visor and second visor according to the aspect of FIGS. 4A-4C.

In certain aspects the second visor 420 could include two panels 440, 450, each of the two panels including a light transmissive region. The two panels 440, 450 may be joined at their edges as shown in FIG. 4B to create the slot 430 for receiving the first visor 410. In particular aspects the two panels 440, 450 are clear or translucent plastic.

Methods for Training Athlete to Adopt a Vertical Head-up Position

Aspects of the disclosure further relate to methods for training an athlete to adopt a vertical head-up position. The method includes:

- placing a visor including an opaque region over an athlete's face such that the opaque region of the visor blocks the upper peripheral vision of the athlete if the athlete lowers his/her head below their vertical head-up position; and
- having the athlete train with the visor over their face to teach them to keep their head in the vertical head-up position, thereby minimizing a risk of head-to-head contact with another athlete during a game.

In some aspects of the method, the visor includes a plurality of score lines such as those described above, and the method further includes removing a portion of the visor at one of the plurality of score lines so as to allow sizing of the visor for athletes of different size.

The method further includes, in some aspects, attaching the visor to a helmet or headgear and placing the helmet or headgear onto the head of the athlete. As explained above, the visor may be attached to the helmet or headgear with any suitable fastening means, including but not limited to one or more of a snap, a strap, a hook and loop fastener, tape, a screw or a pin.

In further aspects placing the visor over the face of the athlete includes placing the visor directly over the face of the athlete with a mounting apparatus attached directly to the visor. The mounting apparatus is a headband in some aspects, although any other suitable mounting apparatus may be used.

The visor used in the method may include a light transmissive region in accordance with aspects described herein, and may include indicator lines, varying degrees of tint and/or varying colors.

In some aspects the visor used in the method may also promote a horizontal head position by the athlete, as described herein. The athlete, if his/her head is too far to the left or the right from vertical, would receive feedback in the form of reduced left/right peripheral vision due to the opaque region of the visor blocking that vision. This would encourage the athlete to straighten his/her head to a more vertical position.

Various combinations of elements of this disclosure are encompassed by this disclosure, e.g., combinations of elements from dependent claims that depend upon the same independent claim.

Aspects of the Disclosure

In various aspects, the present disclosure pertains to and includes at least the following aspects.

Aspect 1: A method for training an athlete to adopt a vertical head-up position, the athlete comprising a head, a face and eyes, the method comprising:

placing a visor comprising an opaque region over the face of the athlete such that the opaque region of the visor blocks an upper peripheral vision of the athlete if the athlete lowers the head below the vertical head-up position; and having the athlete train with the visor over the face to teach the athlete to keep the head in the vertical head-up position, thereby minimizing a risk of head-to-head contact with another athlete during a game.

Aspect 2: The method according to Aspect 1, wherein the visor further comprises a plurality of score lines, and the method further comprises removing a portion of the visor at one of the plurality of score lines so as to allow sizing of the visor for athletes of different size.

Aspect 3: The method according to Aspect 1 or 2, wherein placing the visor over the face of the athlete comprises attaching the visor to a helmet or headgear, and placing the helmet or headgear onto the head of the athlete.

Aspect 4: The method according to Aspect 3, wherein the visor is attached to the helmet or headgear with one or more of a snap, a strap, a hook and loop fastener, tape, a screw or a pin.

Aspect 5: The method according to Aspects 1 or 2, wherein placing the visor over the face of the athlete comprises placing the visor directly over the face of the athlete with a mounting apparatus attached directly to the visor.

Aspect 6: The method according to Aspect 5, wherein the mounting apparatus is a headband.

Aspect 7: The method according to any of Aspects 1 to 6, wherein the visor further comprises a light transmissive region located proximate the opaque region and configured to be below the opaque region when the visor is worn by the athlete such that the athlete can see through the light transmissive region of the visor when the head is in the vertical head-up position.

Aspect 8: The method according to Aspect 7, wherein the visor further comprises a plurality of indicator lines located on the light transmissive region of the visor, wherein the indicator lines are visible to the athlete when the visor is over the face and the indicator lines provide an indication to the athlete of a degree to which the head position is deviating from the vertical head-up position.

Aspect 9: The method according to Aspect 7 or 8, wherein the light transmissive region comprises a first region proximate the opaque region and having a first degree of tint and a second region having a second degree of tint, wherein the first degree of tint is darker than the second degree of tint such that when the visor is over the face the first degree of tint and the second degree of tint provide an indication to the athlete of a degree to which the head position is deviating from the vertical head-up position.

Aspect 10: The method according to any of Aspects 1 to 9, wherein the visor comprises plastic, fabric, rubber, mesh or a combination thereof.

Aspect 11: An apparatus for training an athlete to adopt a vertical head-up position, comprising a visor configured to be worn over a face of an athlete at an eye level of the athlete, the visor comprising:

an opaque region that blocks an upper peripheral vision of the athlete if the athlete lowers the head below the vertical head-up position; and a plurality of score lines, wherein the plurality of score lines allow a portion of the visor to be removed so as to allow sizing of the visor for athletes of different size, wherein the visor teaches the athlete to keep the head in the vertical head-up position, thereby minimizing a risk of head-to-head contact with another athlete during a game.

Aspect 12. The apparatus according to Aspect 11, further comprising a helmet or headgear attached to the visor.

Aspect 13: The apparatus according to Aspect 12, wherein the visor is attached to the helmet or headgear with one or more of a snap, a strap, a hook and loop fastener, tape, a screw or a pin.

Aspect 14: The apparatus according to Aspect 11, further comprising a mounting apparatus attached directly to the visor.

Aspect 15: The apparatus according to Aspect 14, wherein the mounting apparatus is a headband.

Aspect 16: The apparatus according to any of Aspects 11 to 15, wherein the visor further comprises a light transmissive region located proximate the opaque region and configured to be below the opaque region when the visor is worn by the athlete such that the athlete can see through the light transmissive region of the visor when the head is in the vertical head-up position.

Aspect 17: The apparatus according to Aspect 16, wherein the visor further comprises a plurality of indicator lines located on the light transmissive region of the visor, wherein the indicator lines are visible to the athlete when the visor is over the face and the indicator lines provide an indication to the athlete of a degree to which the head position is deviating from the vertical head-up position.

Aspect 18: The apparatus according to Aspect 16 or 17, wherein the light transmissive region comprises a first region proximate the opaque region and having a first degree of tint and a second region having a second degree of tint, wherein the first degree of tint is darker than the second degree of tint such that when the visor is over the face the first degree of tint and the second degree of tint provide an indication to the athlete of a degree to which the head position is deviating from the vertical head-up position.

Aspect 19: The apparatus according to any of Aspects 11 to 18, wherein the visor comprises plastic, fabric, rubber, mesh or a combination thereof.

Aspect 20: An apparatus for training an athlete to adopt a vertical head-up position, comprising:

a first visor configured to be worn over a face of an athlete at an eye level of the athlete, the first visor comprising an opaque region that blocks an upper peripheral vision of the athlete if the athlete lowers the head below the vertical head-up position; and a second visor comprising a light transmissive region and a slot for receiving the first visor, wherein the first visor teaches the athlete to keep the head in the vertical head-up position, thereby minimizing a risk of head-to-head contact with another athlete during a game.

Aspect 21: The apparatus according to Aspect 20, further comprising a helmet or headgear attached to one or both of the first visor and the second visor.

Aspect 22. The apparatus according to Aspect 21, wherein one or both of the visor and the second visor are attached to the helmet or headgear with one or more of a snap, a strap, a hook and loop fastener, tape, a screw or a pin.

Aspect 23. The apparatus according to Aspect 20, further comprising a mounting apparatus attached directly to one or both of the first visor and the second visor.

Aspect 24. The apparatus according to Aspect 23, wherein the mounting apparatus is a headband.

Aspect 25. The apparatus according to any of Aspects 20 to 24, wherein one or both of the first visor and the second visor comprises plastic, fabric, rubber, mesh or a combination thereof.

Methods described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other aspects can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed aspect. Thus, the following claims are hereby incorporated into the Detailed Description as examples or aspects, with each claim standing on its own as a separate aspect, and it is contemplated that such aspects can be combined with each other in various combinations or permutations. The scope of the disclosure should be determined with reference to the appended claims, along with the full scope of equivalents to which such claims are entitled.

That which is claimed is:

1. A method for training an athlete to adopt a vertical head-up position, the method comprising:

placing a visor comprising an opaque region over the athlete's face such that the opaque region of the visor blocks an upper peripheral vision of the athlete when the athlete's head is positioned below the vertical head-up position; and having the athlete train with the visor over the athlete's face to teach the athlete to keep the his/her head in the vertical head-up position, thereby minimizing a risk of head-to-head contact with another athlete during a game.

2. The method according to claim 1, wherein the visor further comprises a plurality of score lines, and the method further comprises removing a portion of the visor at one of the plurality of score lines so as to allow sizing of the visor for athletes of different size.

3. The method according to claim 1, wherein placing the visor over the athlete's face comprises attaching the visor to a helmet or headgear, and placing the helmet or headgear onto the athlete's head.

4. The method according to claim 3, wherein the visor is attached to the helmet or headgear with one or more of a snap, a strap, a hook and loop fastener, tape, a screw or a pin.

5. The method according to claim 1, wherein placing the visor over the athlete's face comprises placing the visor directly over the athlete's face with a mounting apparatus attached directly to the visor.

6. The method according to claim 5, wherein the mounting apparatus is a headband.

7. The method according to claim 1, wherein the visor further comprises a light transmissive region located proximate the opaque region and configured to be below the opaque region when the visor is worn by the athlete such that the athlete can see through the light transmissive region of the visor when the athlete's head is in the vertical head-up position.

8. The method according to claim 7, wherein the visor further comprises a plurality of indicator lines located on the light transmissive region of the visor, wherein the indicator lines are visible to the athlete when the visor is over the athlete's face and the indicator lines provide an indication to the athlete of a degree to which the head position is deviating from the vertical head-up position.

9. The method according to claim 7, wherein the light transmissive region comprises a first region proximate the opaque region and having a first degree of tint and a second region having a second degree of tint, wherein the first degree of tint is darker than the second degree of tint such that when the visor is over the athlete's face the first degree of tint and the second degree of tint provide an indication to the athlete of a degree to which the athlete's head position is deviating from the vertical head-up position.

10. The method according to claim 1, wherein the visor comprises one of a plastic, fabric, rubber, mesh or a combination thereof.

* * * * *